US005676179A

United States Patent [19]

Morandi

[11] Patent Number: 5,676,179

[45] Date of Patent: Oct. 14, 1997

[54] ELECTRONICALLY CONTROLLED SHEDDING MECHANISM

[75] Inventor: Marcos Morandi, Sao Bermardo Do Campo, Brazil

[73] Assignee: MaqTex Maquinas Texteis Industria e Comercio LTDA-ME, Sao Paulo, Brazil

[21] Appl. No.: 436,267

[22] PCT Filed: Sep. 1, 1994

[86] PCT No.: PCT/BR94/00030

§ 371 Date: Jun. 26, 1995

§ 102(e) Date: Jun. 29, 1995

[87] PCT Pub. No.: WO95/06767

PCT Pub. Date: Mar. 9, 1995

[30] Foreign Application Priority Data

Sep. 1, 1993 [BR] Brazil ..... 9303183
Aug. 18, 1994 [BR] Brazil ..... 9403276

[51] Int. Cl.[6] ..... D03C 3/20; D03C 3/24

[52] U.S. Cl. ..... 139/455

[58] Field of Search ..... 139/455

[56] References Cited

U.S. PATENT DOCUMENTS 2,204,891 6/1940 Hamilton .
3,186,439 6/1965 Seiler .
5,327,750 7/1994 Speich ..... 139/455

FOREIGN PATENT DOCUMENTS 0304985 3/1989 European Pat. Off. .
304985 3/1989 European Pat. Off. .
1331857 5/1963 France .
2675826 10/1992 France .
2203925 8/1973 Germany .
1781338 12/1992 Russian Federation ..... 139/455
186440 11/1963 Sweden ..... 139/455

OTHER PUBLICATIONS

Patent Abstract of Japan, vol. 15, No. 227 (C–0839) 16 Jun. 1991 & JP, A,03 069 626, 26 Mar. 1991—see abstract.

*Primary Examiner*—Andy Falik
*Attorney, Agent, or Firm*—Cushman, Darby & Cushman IP Group of Pillsbury Madison & Sutro LLP

[57] ABSTRACT

A mechanism for selectively raising selected threads in the warp of a weaving machine to form a shed includes a plurality of vertically movable rods which raise the selected threads and which are electronically controlled by a rod control apparatus. The rod control apparatus may be in the form of a solenoid or an electrical coil combined with an electrically neutral seat member. The mechanism is part of a block structure which rises and falls. When the block structure rises each rod either moves up with the block to raise a thread or the rod remains stationary, depending on the status of rod control apparatus.

2 Claims, 14 Drawing Sheets

ELECTRONICALLY CONTROLLED SHEDDING MECHANISM

BACKGROUND OF THE INVENTION

1. Field of the Invention

The present invention relates to a mechanism having a plurality of electronically controlled rods for selectively raising selected threads in a warp of a weaving machine to form a shed.

2. Description of the Prior Art

The use of Jacquard-type machines and the like, designed to form a shed in flat weaver's looms, is wide-spread. However, these traditional systems have developed very little throughout the years, and still today employ practically the same features of their first models introduced in France two hundred years ago.

Such traditional devices, besides being rather bulky, operate on platforms mounted above the looms, requiring costly installations for their aerial support, and operate through complex sets of needles, cards, tie rods, etc., resulting in an extremely elaborate structure which demands expensive maintenance.

In general all of these pieces of equipment, which operate by pulling the tie rods carrying the warp threads upwards, are regarded as conventional and have caused the conceptual stagnation of the technical devices which have been used thus far.

SUMMARY OF THE INVENTION

The present invention provides a new solution, completely different from the traditional systems, since, according to the invention, the warp threads are taken upwards in a totally different manner—they are pushed upwards by a specific functional unit which may even stand on the floor, with all the advantages of an easy installation offered by this important innovation.

The attached schematic drawings (FIGS. 1 through 21) illustrate, in a simplified manner, the present invention, which consists of several functional units, working independently, arranged sequentially and mounted inside a fixed body C placed between the warp beam R and the comb P of the loom (not depicted), the units consisting of a vertically oriented rod 1 provided with a ring 2 in its center and, above this ring, a coaxial extension 3; a conventional electrical solenoid 4 with a horizontally movable shaft 5 having an opening 6 for the passage of the rod 1; a metallic sheet 7 for electrical contact and for fastening the solenoid 4 in relation to the rod 1; an intermediate vertically oriented slot 8 for guiding the portion of the rod 1 located above the solenoid 4 and coaxial to the opening 6; a lower vertically oriented slot 9 for guiding the portion of the rod 1 located below the solenoid 4 and coaxial to the opening 6; an upper vertically oriented slot 10 for guiding the extension 3 of the rod 1 and coaxial to the opening 6; a block 11, which can be moved up and down where the removable solenoid 4 is fastened and where a metallic sheet 7 and the upper, lower and intermediate slots are provided. The block also contains a wall (12) on its top, for closing the upper part of the upper slot (10); a movable plate 13 for driving the shaft 5 towards the opening 6 of the solenoid 4; a rigid shield 14 with an opening 15 for the passage of the rod 1 coaxial to upper, lower and intermediate slots, said shield being mounted below the ring 2, and the opening 15 being provided with a rim 16 for the protection and support of said ring 2.

The equipment is of simple operation due to its special structure which lifts and lowers the warp thread, passing it through the ring 2, as it can be seen in the enclosed illustrations.

DESCRIPTION OF THE PREFERRED EMBODIMENT

Figure 1:
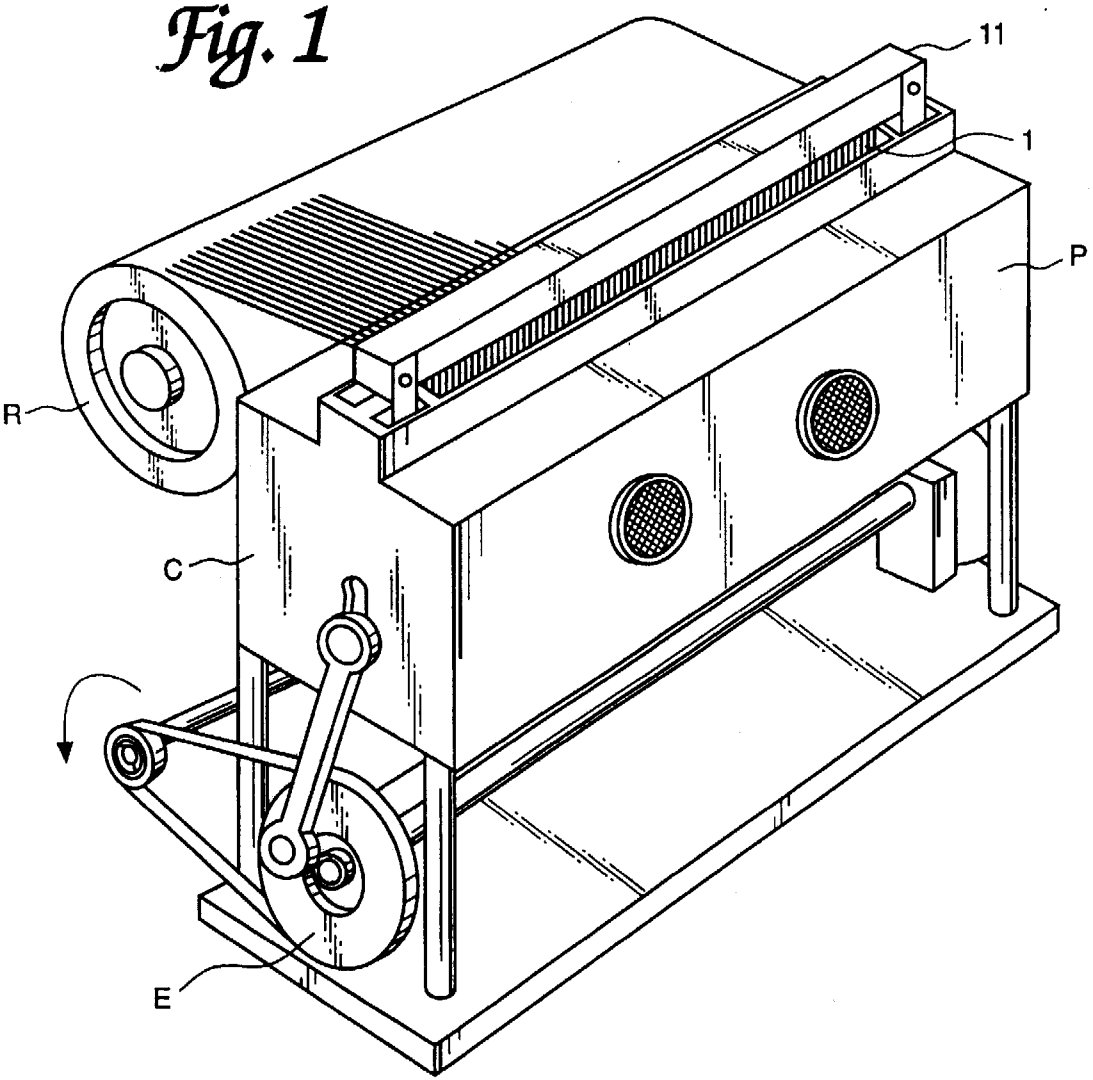
FIG. 1 is a perspective view of a machine housing the mechanism of the present invention.

FIG. 1 is a perspective view of the fixed body C housing the equipment of this invention which, as previously mentioned, can stand on the floor, dispensing with the costly equipment for aerial support required by traditional systems.

In its essence, the elements of the invention operate in mutual coordination, basically driven by the action of the shaft 5 of the solenoid 4, which in two successive positions either blocks (FIGS. 2, 3, 4) or unblocks (FIGS. 5, 6) the passage of the rod 1 through its opening 6.

The warp thread F passes through the ring 2, and is lifted by the respective rod 1.

Figure 2:
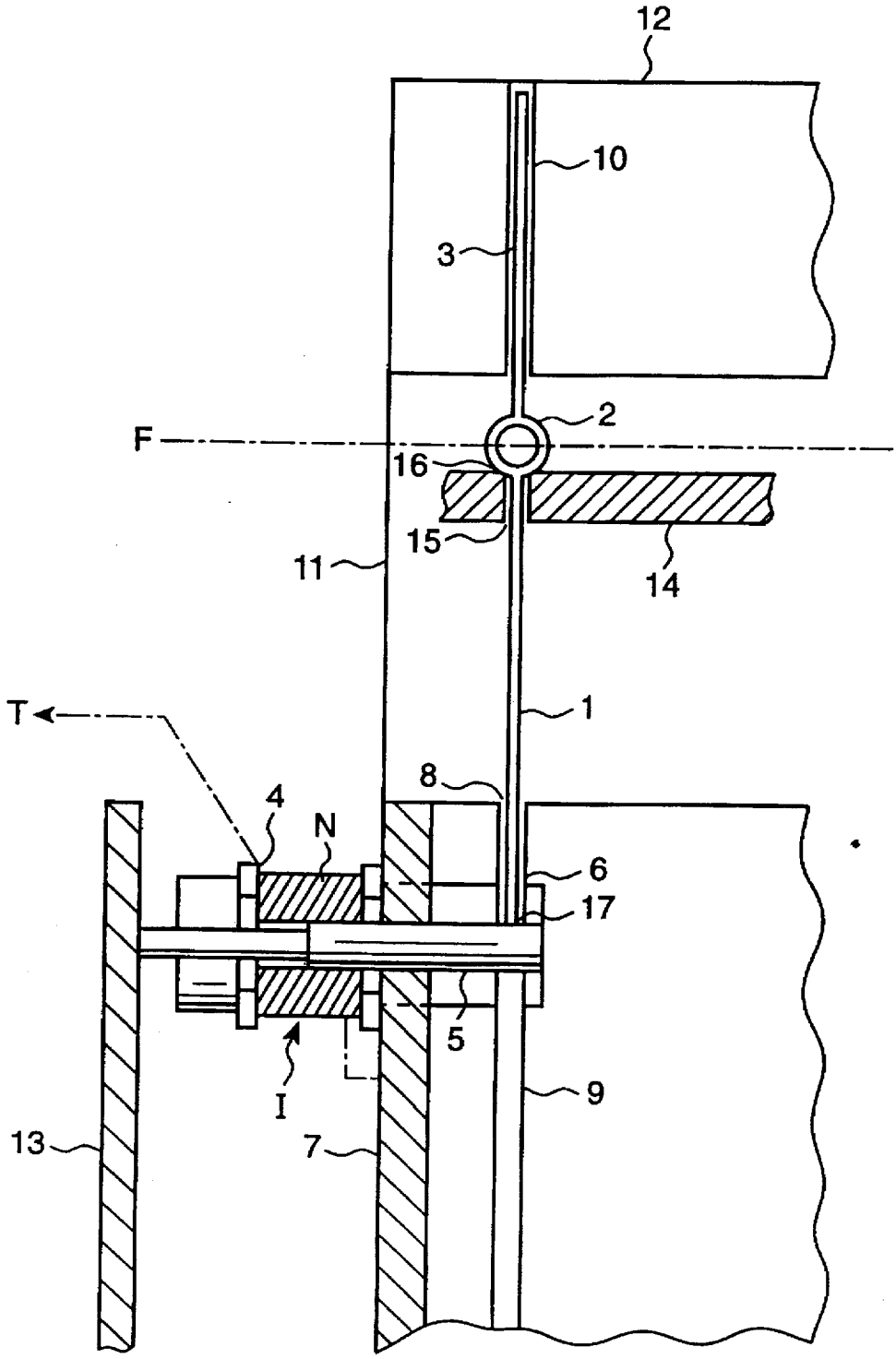
FIGS. 2–6 are partial elevations, partially in cross-section, of the lift rod and the lift rod controlling solenoid of the present invention depicting the mechanism in different stages of operation.

In the blocking position, while the block 11 is stopped in the lowered position, the rod 1 remains inactive, the ring 2 resting on the shield 14. At all times in this stage and rod 1 remains housed inside the upper intermediate slots 10 and 8, with its lower end 17 in contact with the shaft 5 of the solenoid 4. In this stage, the plate 13 presses against said shaft 5, thus blocking the opening 6 (FIG. 2). As this plate can be moved by any adequate means, whether electrical or mechanical, this feature does not constitute a particular feature of this invention.

Figure 3:
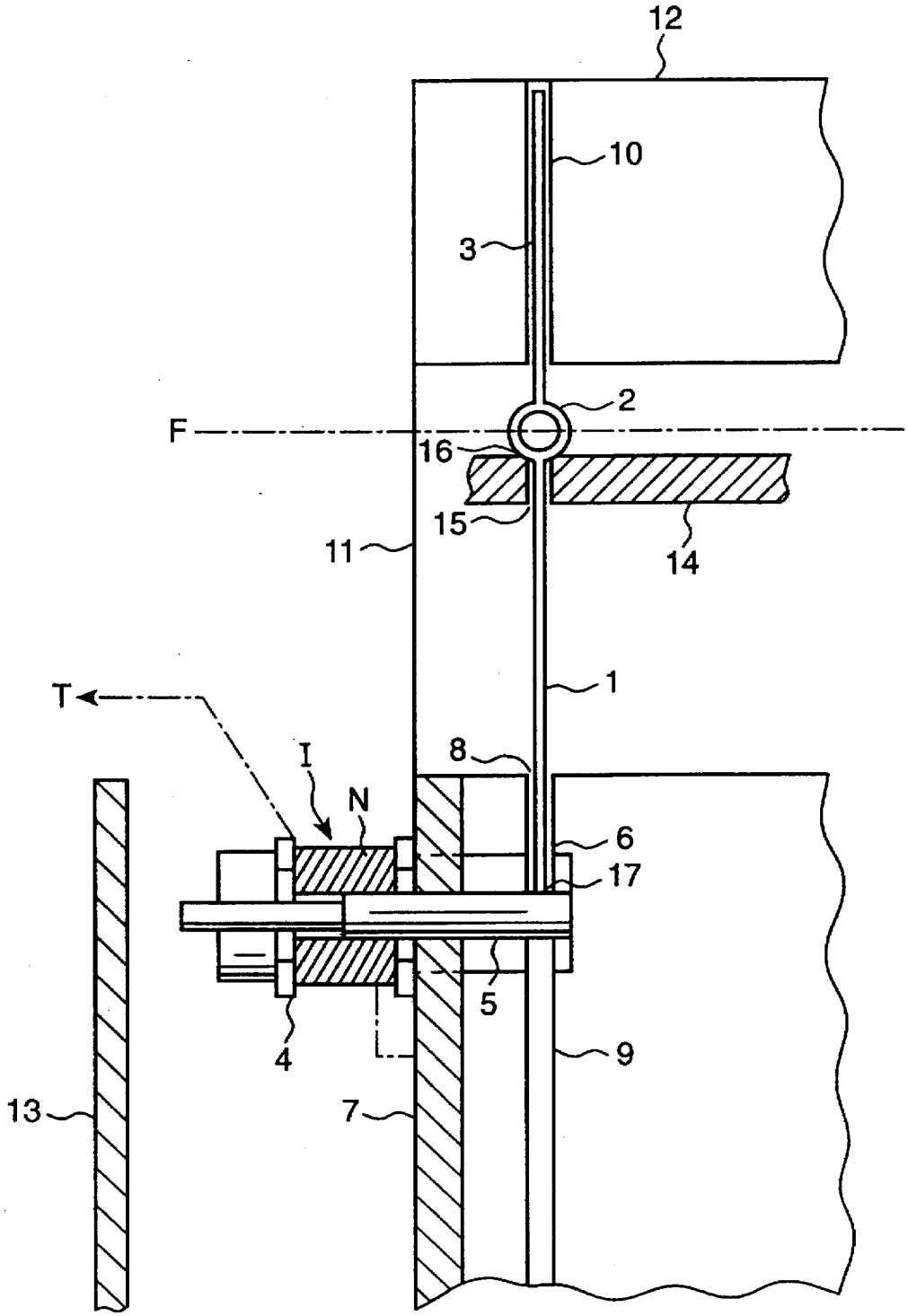

In order to drive the rod 1 upwards, plate 13 has to be moved backwards thus releasing the shaft 5, which, due to its own inertia, still continues blocking said opening 6 (FIG. 3).

The rod 1 starts becoming slightly lifted when the block 11, duly provided with the solenoid 4, metallic sheet 7 and the intermediate, lower, and upper slots 8, 9 and 10, moves upwards.

According to this invention, the solenoid 4, the metallic sheet 7 and the intermediate, lower, and upper slots 8, 9 and 10 are all linked to block 11 which can be moved vertically up and down by the usual mechanical means such as, for instance, a cam E (illustrated in FIG. 1 in a simplified manner).

Figure 4:
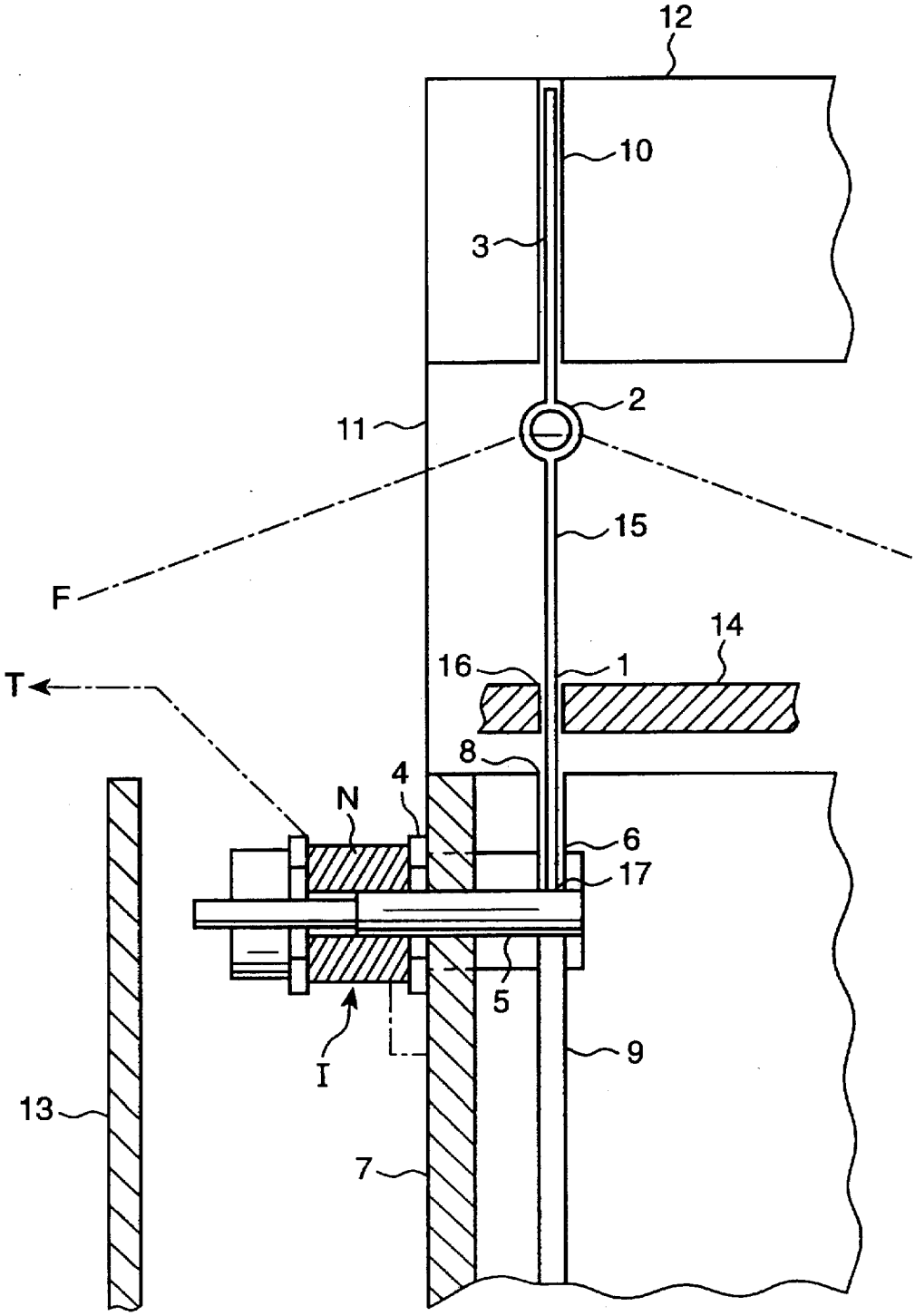

As the block 11 moves upwards, the shaft 5 of the solenoid 4 pushes up the rod 1 so that the latter takes the warp thread F along, passing it through ring 2, thus completing the first operation stage of the invention (FIG. 4).

The rod 1 is brought back to its starting position when the block 11 is pulled down by its superior wall, as illustrated in FIG. 2.

The complete invention consists, as previously mentioned, of a variable number of operational units like the ones described above, duly arranged and assembled inside the block 11.

As mentioned before, each one of the units is autonomous, acting individually and independently inside the equipment.

Therefore, the invention allows for the selection of the rods which are to be slightly lifted, according to the effect desired in the resulting fabric.

In order to select the rods, you only have to start the solenoid you want, thus causing, as described above, the lifting of the respective rod.

Based on the fact that when the block 11 moves upwards it brings along all units forming the set, this invention presupposes the immobilization, in the lowered position, of the rods which are to be kept in this position.

Figure 5:
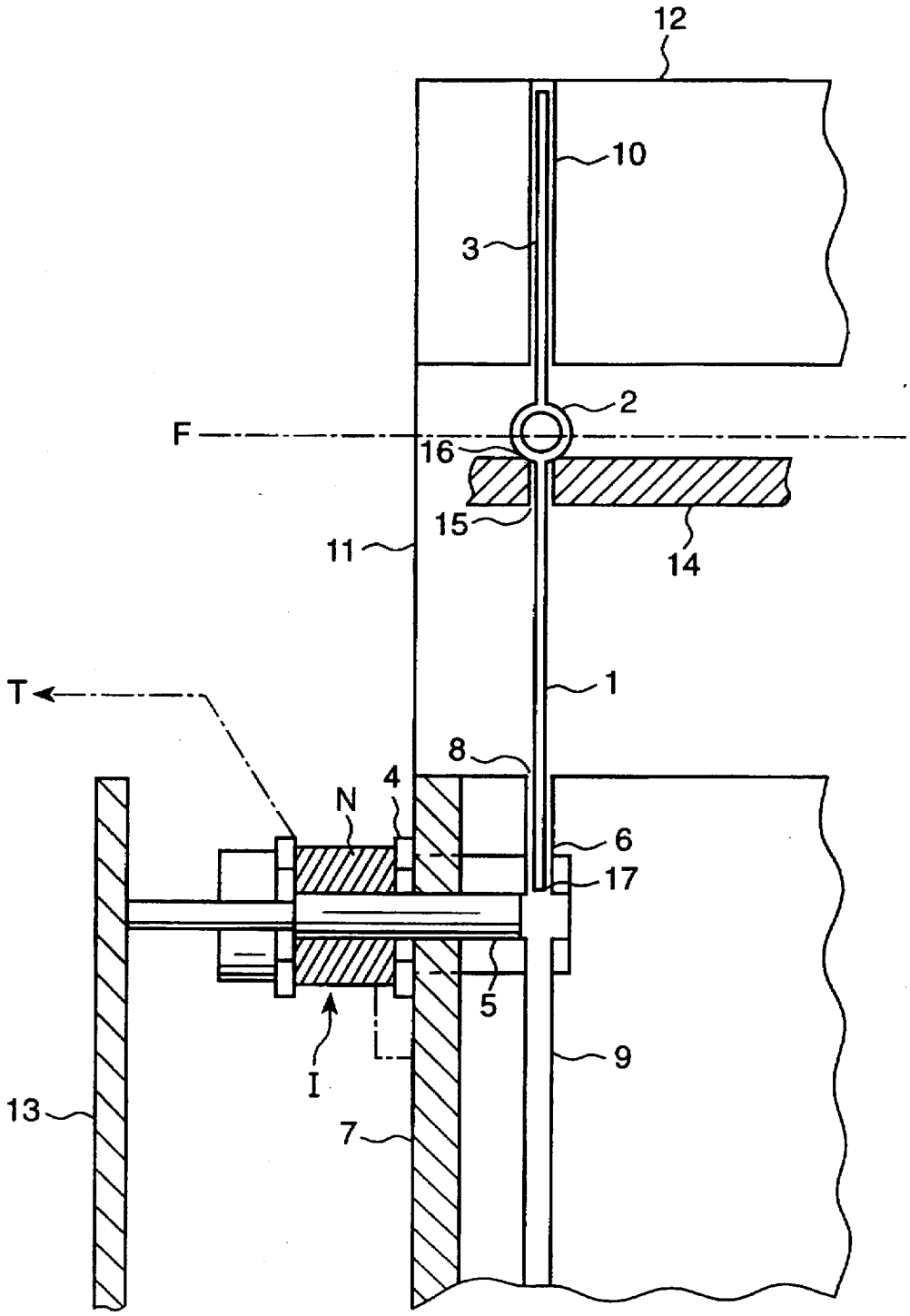
Figure 6:
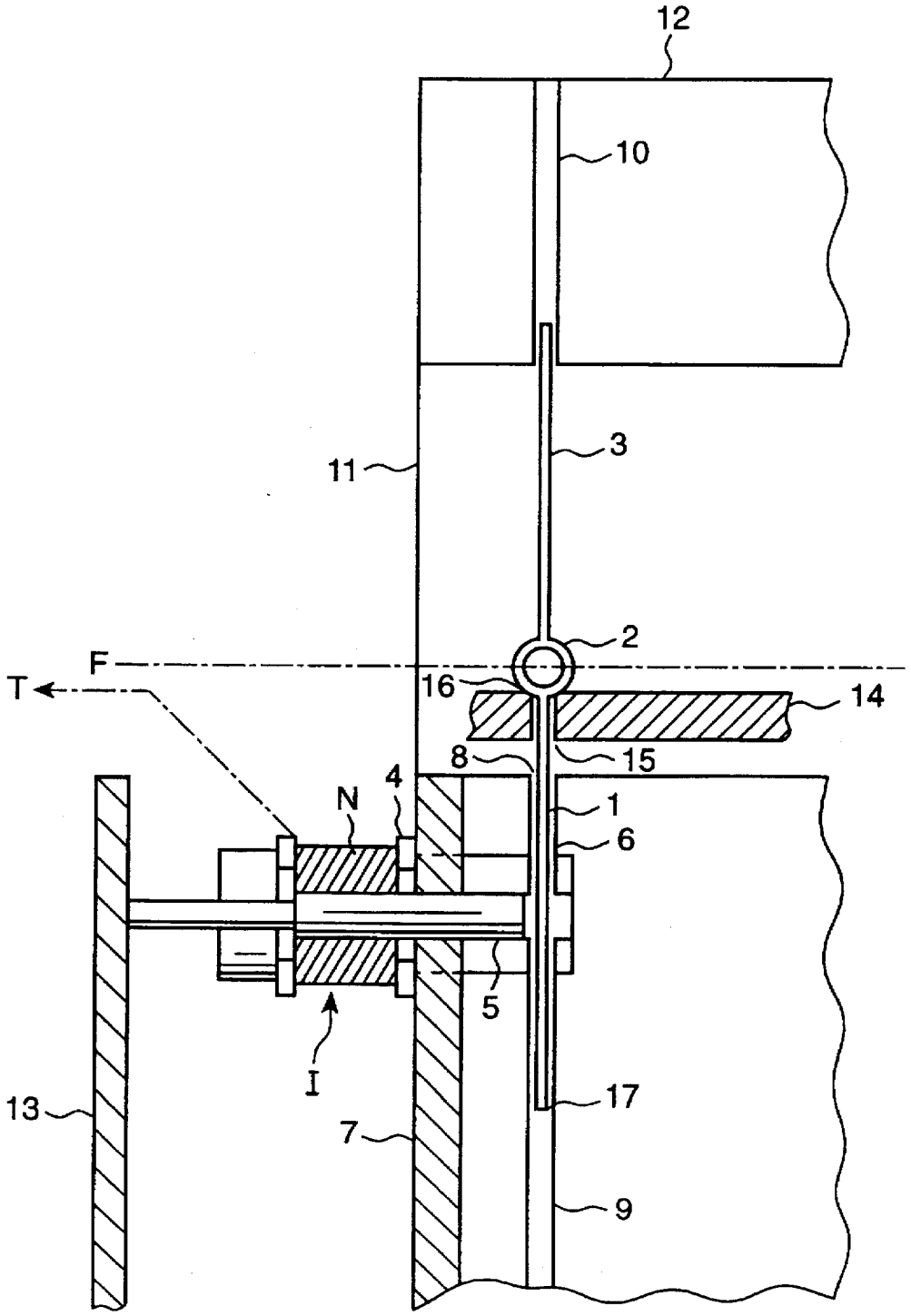

You just have to turn on the electrical circuit of the selected solenoid and this will make the shaft 5 move towards the plate 13, thus unblocking the passage of the opening 6. The respective rod 1 remains inactive, supported by the ring 2 on the shield 14 (FIG. 5). When the block 11 moves upwards, this rod will not be pushed, since it passes freely through the opening 6 of the solenoid 4 (released by the retreat (setback) of the shaft 5) and starts to occupy the inside of lower slot 9 coaxially placed below the solenoid (FIG. 6).

Upon the return of block 11 to its starting position, the unit returns to the situation illustrated in FIG. 5. As a consequence, rod 1 unblocks the return of the shaft 5, which resumes the position illustrated in FIG. 2 as soon as it is pushed by the plate 13.

Figure 7:
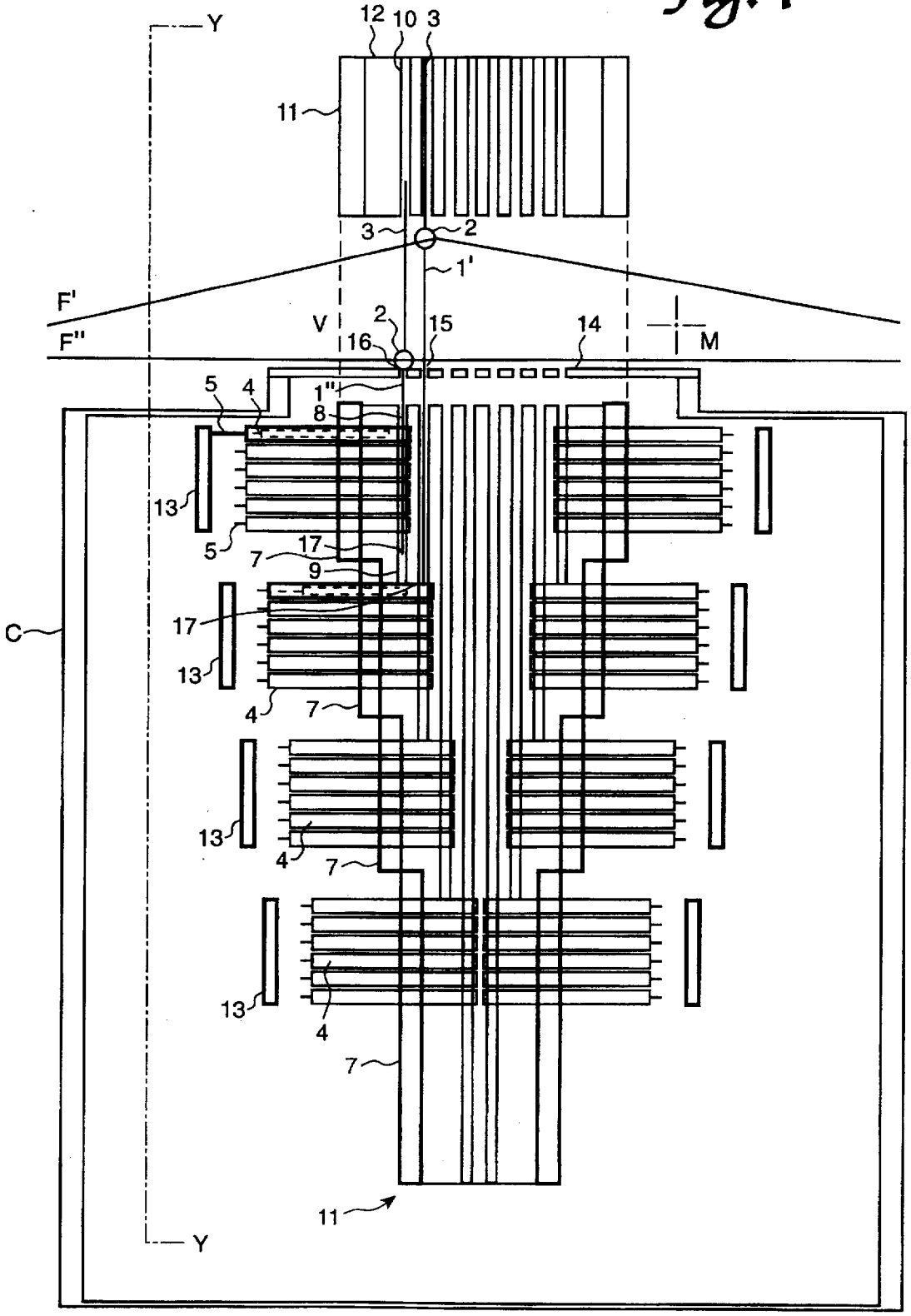
FIG. 7 illustrates a plurality of lift units according to the present invention.

FIG. 7 illustrates as an example a multiple combination of the units aggregated to the block 11 and properly arranged according to several different practical needs. For a better understanding, only two units are schematically illustrated, one (corresponding to FIG. 4) in which the rod 1' is raised, slightly raising the warp thread F', and the other (corresponding to FIG. 6) in which the rod 1" is at rest, keeping the warp thread F" in the lowered position. The relative positions of these two rods illustrate the shed thus formed establishing between them a gap V through which the weft M passes at each operative cycle of the invention.

Figure 8:
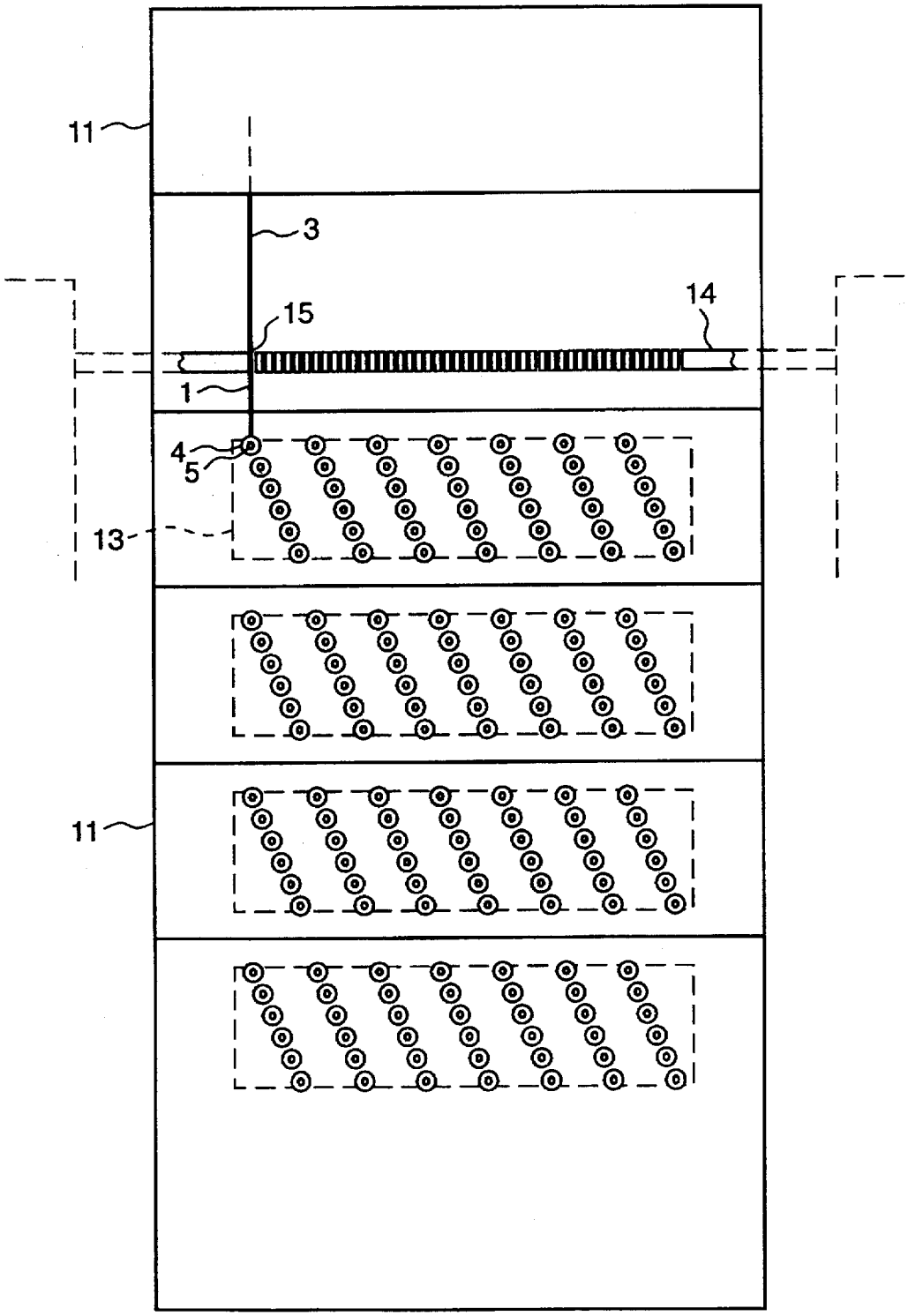
FIG. 8 is a side view taken along the line Y—Y in FIG. 7.

FIG. 8 is a side view taken from the line Y—Y of drawing 7, illustrating the unmatched positions of the solenoids 4 in the equipment considered in different planes so that the rod 1 may operate solely in relation to its respective solenoid, without interfering with any other solenoid in the set.

Figure 9:
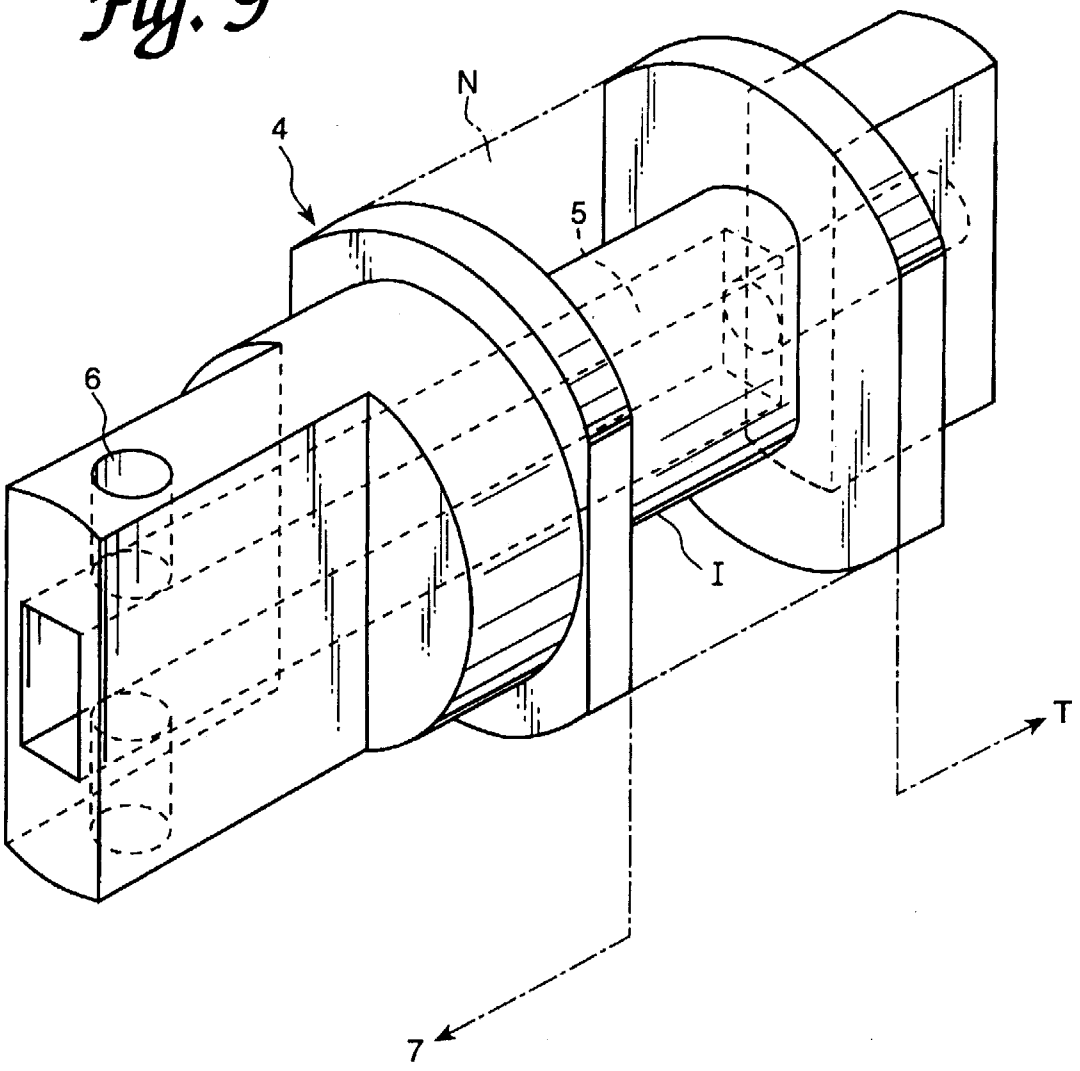
FIG. 9 is a perspective view of a solenoid employed in the mechanism of the present invention.
Figure 12:
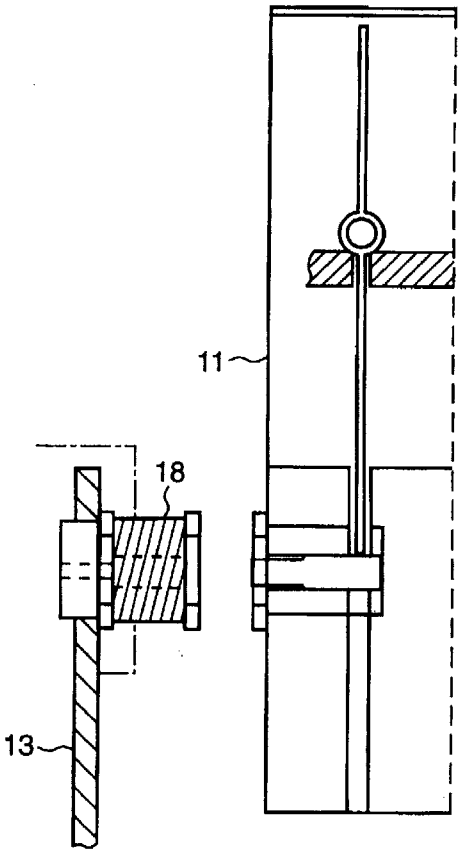
FIGS. 10–21 illustrate the present invention according to an alternate embodiment thereof.

Finally, FIG. 9 is a supplementary view, in perspective, of the solenoid 4, conventionally started by an electrical circuit but characterized by the fact that it is installed transversely to said vertical opening 6 for the passage of the rod 1. As usual, the solenoid includes an intermediary beam I, where the coil N (represented by the broken line) is located, the respective electrical circuit being established through the contact of the latter with the power supply T, on one side, and with the metallic sheet 7 of the operational unit object of the invention, on the other side.

The general reset of the invention, aiming at the complete restart of the operational cycle, is preceded, at all times, by the return of plate 13 to its original position, pressing the shaft 5, thus blocking the opening 6 of the solenoid, as represented in FIG. 2.

Alternatively, the function of the solenoid (4) can be performed by a device consisting of an electrical coil and an electrically neutral seat member with an axial opening for the passage of the horizontal shaft. The seat member is, likewise, provided with a vertical opening for the passage of said rod.

The remaining drawings (FIGS. 10 through 21) illustrate this alternative which can be described as follows: a vertical rod 1, with a lower end 17, the rod being provided with a ring 2 in its upper part for the passage of the warp thread F and, above this, a coaxial extension 3; an electrical coil 18 fastened to a metallic plate 13, which can be moved to the sides, electrically connected with said coil 18; a seat 19, electrically neutral, with an axial opening 20 for the horizontally movable shaft 5 to slide through. The seat is placed transversely and has a vertical opening 6 for the passage of the rod 1; an intermediate vertical slot 8 for guiding the portion of the rod 1 above the seat 19 and coaxial to the opening 6; a lower vertical slot 9 for guiding the portion of the rod 1 below the seat 19 and coaxial to the opening 6; a block 11, which can be moved up and down where the removable seat 19 is fastened and where slots 8 and 9 are provided. The block is also provide with a wall 12 on its top for closing its upper part; a fixed shield 14 with an opening 15 for the passage of the rod 1, coaxial to slots 8 and 9, the shield being mounted below the ring 2 and the opening 15 being provided with a border 16 for the protection and support of the ring 2.

The arrangement of this alternative permits, through the interaction of the movements of the shaft 5 and of the block 11 of each of its functional units, the selection of rods 1 which are to be moved upwards or downwards at each cycle of the equipment according to the effect desired in the resulting fabric. In this system you can choose whether or not the rod 1 will be moved upwards or downwards in coordination with the block 11, with the resulting movement of the warp thread F carried by each of the rods forming the entire functional unit at issue.

The text below describes a functional unit based on the present alternative in its successive stages of lifting and lowering the block 11, optionally bringing along the rod 1 in the same movement. All drawings together repeat basically the illustrations contained in FIGS. 2 to 9, this time showing the functional unit equipped with the coil 18 and the seat 19 with a vertical opening 6 and its peripheral functional elements: a metallic plate 13 (attached to the coil 18 and making electrical contact with the same through the connection L) and a horizontally movable shaft 5 (aggregated to said seat 19). As it can be observed from the figures, the coil 18 is connected, through one of its poles T, with the circuit in order to close the current. It can also be observed that, according to the present alternative, the following elements were eliminated: the metallic plate (for the support and electrical contact of the solenoid (also eliminated)) and the slot located in the upper part of the block 11 for housing the extension 3 of the rod 1 (with experience, the housing proved to be dispensable). Furthermore, the plate 13, once electrically neutral, is now, according to the present alternative, electrically active so as to allow the energization of the coil 18.

Figure 11:
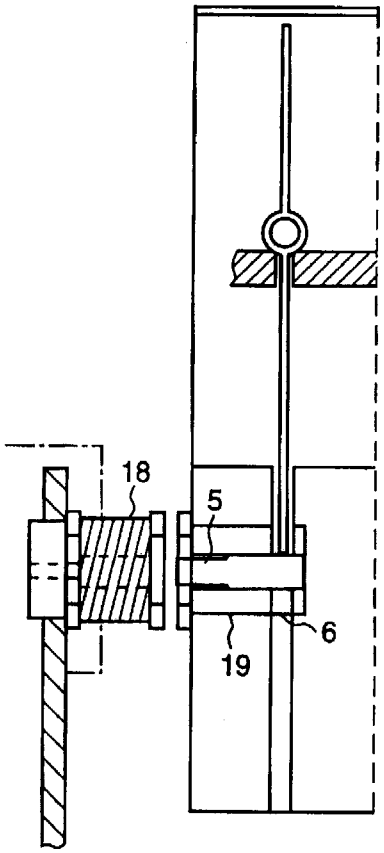
Figure 10:
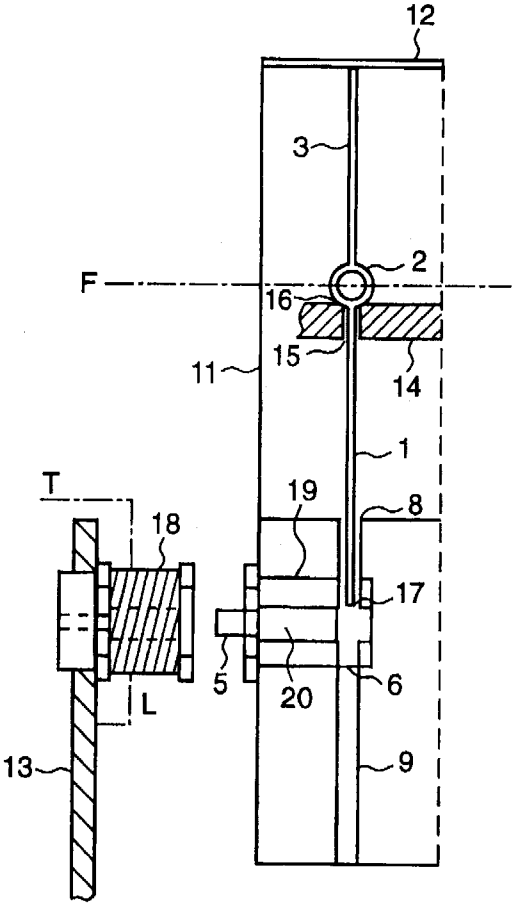
Figure 15:
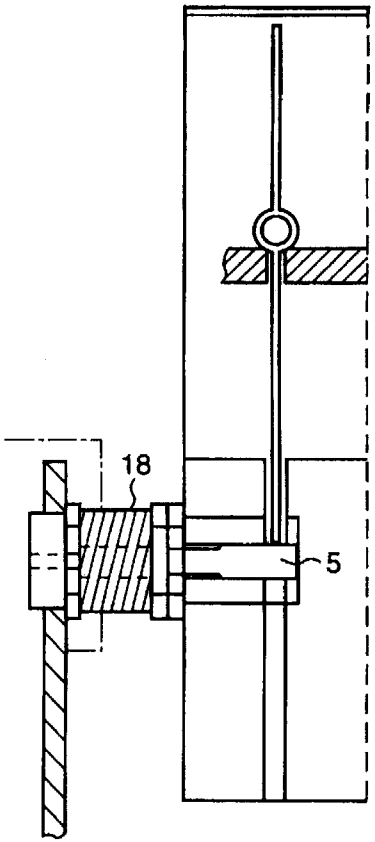
Figure 13:
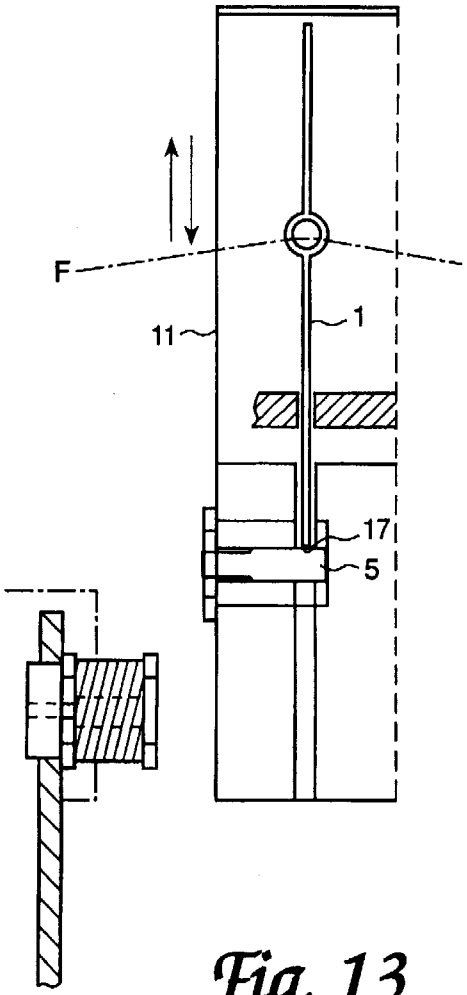
Figure 18:
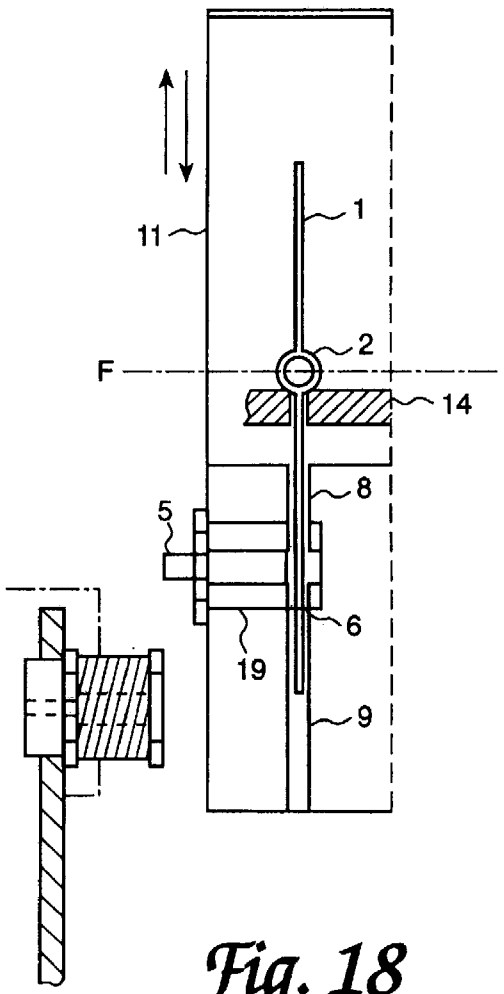

So, in its operation and according to this device, in order to lift the rod 1, the metallic sheet, starts at rest (FIG. 10), is moved by any adequate means against the seat 19, in coordination with the block 11, causing the coil 18 (not energized and coaxial in relation to the shaft 5) to push said shaft into the seat 19, blocking the opening 6 of said seat (FIG. 11). Subsequently the coil 18 (not energized backs off to its previous position, at rest (FIG. 12), causing the block 11 to start moving upwards, bringing along the rod 1 supported by its lower end 17 in the shaft 5 (FIG. 13). Upon its return to the lower position, the block 11 brings along the rod 1 (caught between the superior wall 12 of the block 11 and the shaft 5), thus the set returns to the position in FIG. 10 for restarting the lifting cycle of said block bringing along the rod 1.

Figure 14:
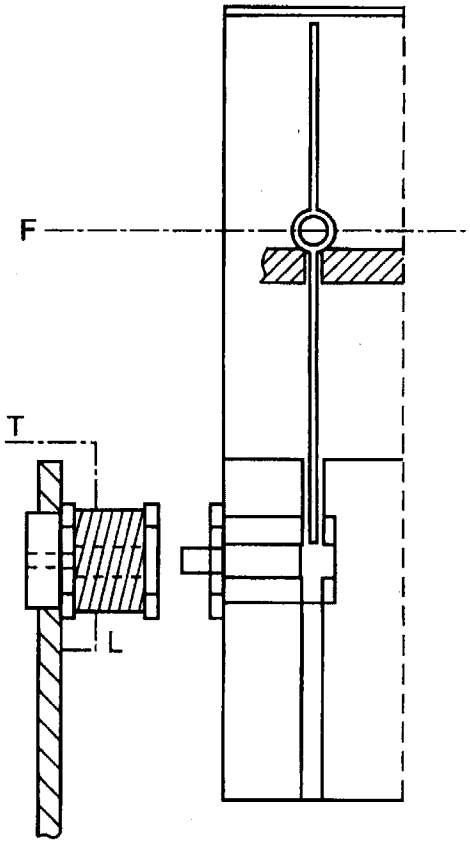
Figure 17:
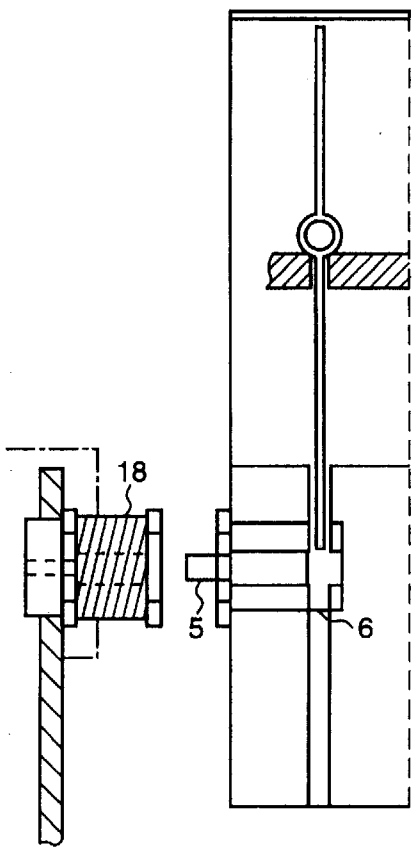
Figure 16:
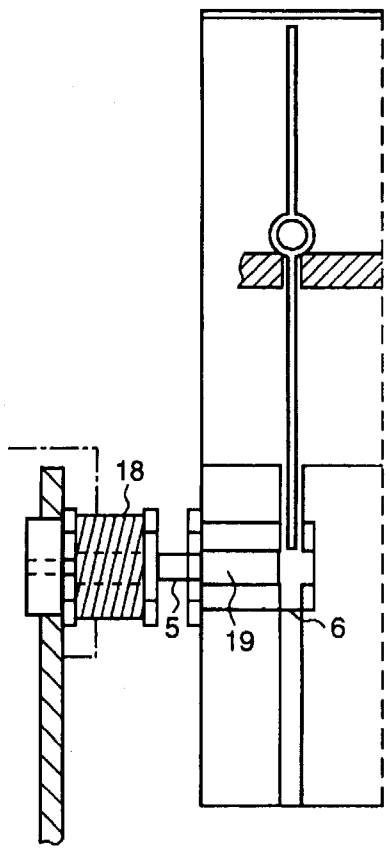

On the other hand, when the rod 1 is to be kept immobilized, simply supported by its ring 2 on the fixed shield 14, while the block 11 moves up and down, according to the invention you only have to bring the coil 18 from the starting position illustrated in FIG. 14 closer to the shaft 5 (FIG. 15) and then said coil will be electrically energized. Once energized and returning to its starting point, said coil pulls magnetically the shaft 5 partially outside the seat 19, thus unblocking said opening 6 (FIGS. 16 and 17).

As block 11 moves upwards, the rod 1, released from the shaft 5, remains immobilized, at rest, supported by its ring 2 in the fixed shield 14, freely sliding throughout the slots 8 and 9 of said block and of the opening 6 of the seat 19 (FIG. 9). The same occurs when the block returns to its lower position (FIG. 5) for restarting the lifting cycle of said block.

Figure 19:
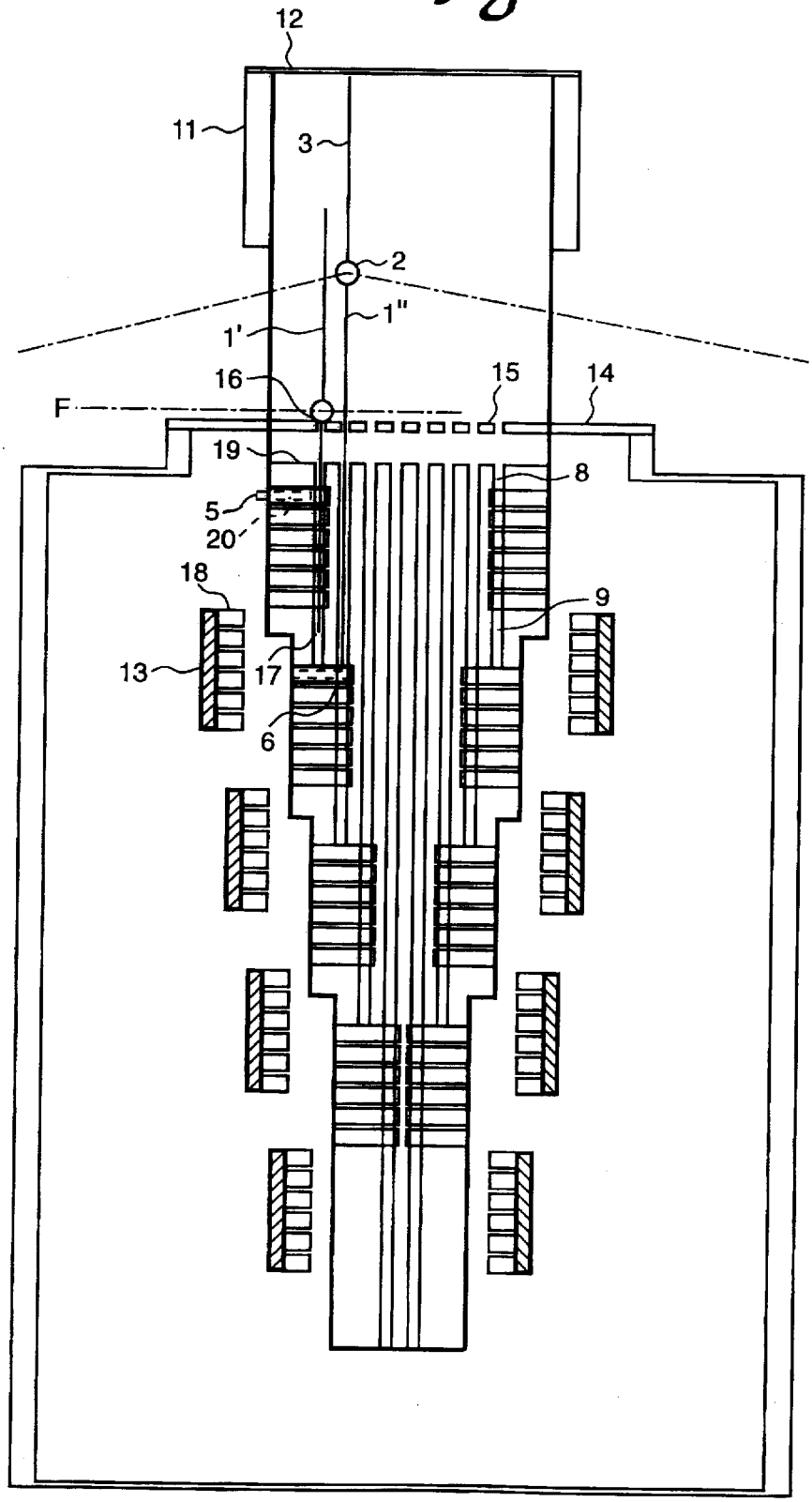

As one can observe, the device permits, through the movement of the plate 13 by any adequate means, and through the energization (or not) of the coil 18, the selection of the rods 1 which are to be lifted together with the block 11 at each movement of the block according to the effect desired in the resulting fabric, because each rod determines the movement of the warp thread F passing through its ring 2. FIG. 19 illustrates schematically the various rods (1', 1") which will or will not join in the upwards movement of block 11, at each movement of the set.

Figure 20:
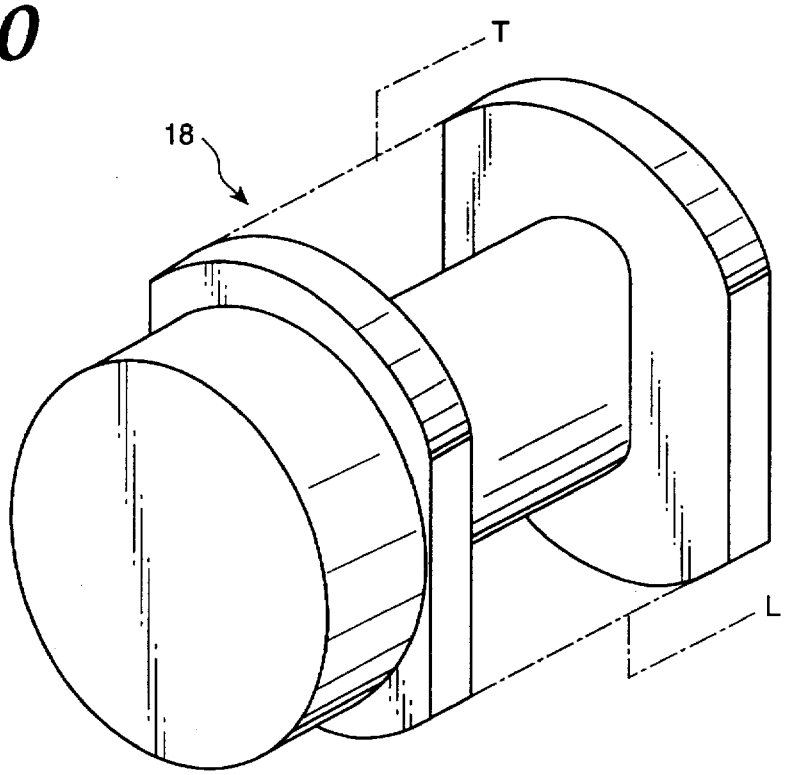
Figure 21:
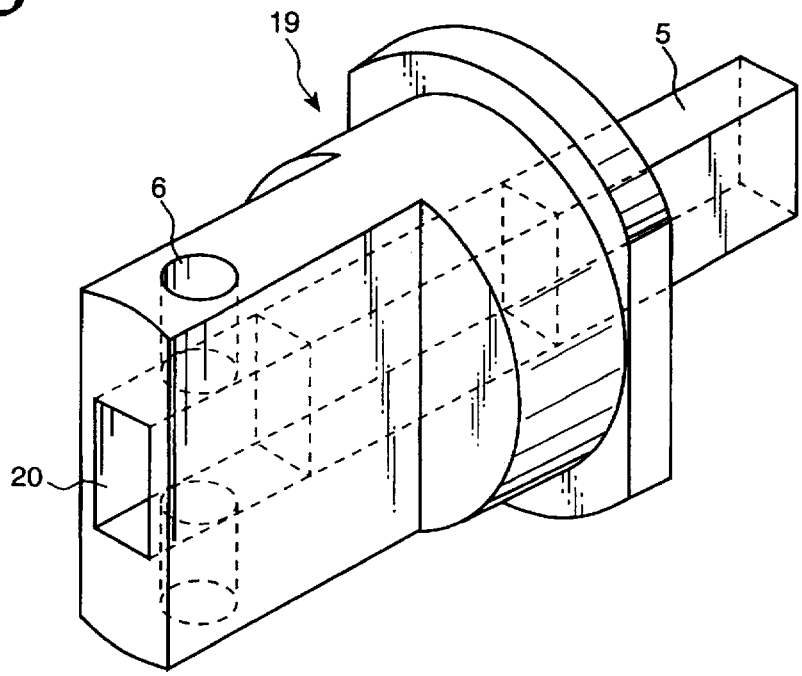

Finally, FIGS. 20 and 21 are separate perspective views of coil 18, electrically connected to the metallic plate 13 by the wiring L and to the closing of the circuit through the wiring T, and of the seat 19 with an axial opening 20 and a vertical opening 6, said seat being intended for housing and sliding of the horizontally movable shaft 5.

I claim:

1. Electromagnetic shedding unit for a loom adapted to be located between the comb and the warp beam in the loom, said unit comprising:

a block adapted to be moved vertically upwards;

a vertical rod provided with a ring located along the length of said rod, a part of the rod located above the ring forming an upper coaxial extension and a part of the rod located below the ring forming a lower coaxial extension;

an electrical solenoid fastened to said block and having a horizontally movable horizontal shaft extending therethrough, said solenoid having a vertical opening formed therein for the passage of the lower coaxial extension of said vertical rod therethrough;

a metallic sheet attached to said block and providing an electrical contact and coupling said solenoid with said vertical rod, said block defining upper, lower, and intermediate vertical slots coaxially with said vertical opening of said solenoid, the upper vertical slot guiding the upper coaxial extension and the lower and intermediate slots guiding the lower coaxial extension, said block having a wall on an upper part thereof which closes off a top end of said upper vertical slot;

a moveable plate for driving said horizontal shaft toward said vertical opening of said solenoid; and a rigid shield having an opening coaxial with said upper, lower and intermediate vertical slots for passage of said vertical rod therethrough, said shield being disposed below said ring and said opening of said shield having a rim for support of said ring.

2. Electromagnetic shedding unit for a loom adapted to be located between the comb and the warp beam in the loom, said unit comprising:

a block adapted to be moved vertically upwards;

a vertical rod provided with a ring located along the length of said rod, a part of the rod located above the ring forming an upper coaxial extension and a part of the rod located below the ring forming a lower coaxial extension;

an electrical coil;

an electrically neutral seat member fastened to said block and having a movable horizontal shaft extending therethrough, said seat member having a vertical opening formed therein for the passage of the lower coaxial extension of said vertical rod therethrough;

said block defining lower and upper vertical slots coaxially with said vertical opening of said seat member for guiding the lower coaxial extension;

a horizontally moveable metallic plate with said electrical coil electrically connected thereto for driving said horizontal shaft toward said vertical opening of said seat member; and a rigid shield having an opening coaxial with said lower and intermediate vertical slots for passage of said vertical rod therethrough, said shield being disposed below said ring and said opening of said shield having a rim for support of said ring.

* * * * *